US005913314A

United States Patent [19]

Garrett

[11] Patent Number: 5,913,314

[45] Date of Patent: Jun. 22, 1999

[54] COMBINATION SALON TOOL DEVICE

[76] Inventor: Michelle R. Garrett, 8222 Streamwood Dr., Baltimore, Md. 21208

[21] Appl. No.: 09/166,751

[22] Filed: Oct. 5, 1998

[51] Int. Cl.[6] ..... A45D 24/22

[52] U.S. Cl. ..... 132/112; 132/114; 401/268

[58] Field of Search ..... 132/114, 112, 132/113, 115, 116, 207, 208, 317, 320; 401/17–25, 26, 279, 268, 36, 136, 176, 182, 179, 287

[56] References Cited

U.S. PATENT DOCUMENTS

| | | | |
|---|---|---|---|
| 1,570,013 | 1/1926 | Smith | 132/114 |
| 1,574,418 | 2/1926 | Coviello | 132/113 |
| 1,686,981 | 10/1928 | Olson . | |
| 1,770,943 | 7/1930 | Newton . | |
| 2,103,493 | 12/1937 | Robertson . | |
| 2,532,001 | 11/1950 | Williams . | |
| 3,101,086 | 8/1963 | Di Vito . | |
| 4,310,009 | 1/1982 | Shipp . | |
| 4,370,989 | 2/1983 | Taylor | 401/126 |
| 4,592,376 | 6/1986 | Sigmund et al. . | |
| 4,813,439 | 3/1989 | Morgan | 132/116 |
| 4,826,340 | 5/1989 | Rothweiler et al. | 401/279 |
| 4,934,388 | 6/1990 | Gibbs | 132/116 |
| 5,054,504 | 10/1991 | Winrow . | |
| 5,056,480 | 10/1991 | Murray, Sr. . | |
| 5,060,679 | 10/1991 | Christopher et al. | 132/114 |
| 5,289,833 | 3/1994 | McDonald . | |
| 5,291,905 | 3/1994 | Busch et al. . | |
| 5,311,887 | 5/1994 | Ramsey | 132/114 |
| 5,333,627 | 8/1994 | Mehringer et al. | 132/108 |
| 5,339,839 | 8/1994 | Forcelledo et al. . | |
| 5,388,728 | 2/1995 | Gueret . | |
| 5,555,899 | 9/1996 | Foreman . | |
| 5,749,117 | 5/1998 | Forsline | 15/245.1 |

FOREIGN PATENT DOCUMENTS

| | | |
|---|---|---|
| 463979 | 1/1992 | France . |
| 969378 | 9/1963 | United Kingdom . |

*Primary Examiner*—Gene Mancene
*Assistant Examiner*—Pedro Philogene
*Attorney, Agent, or Firm*—Richard C. Litman

[57] ABSTRACT

A combination salon tool device with an airtight compartment for dispensing permanent, neutralizer and the like solutions or creams. A rat-tail and an accessory attachment are positioned on opposite ends of a flexible body which contains the solution or cream. The various useful attachments include a perm brush, a circular color cap, a comb, a filamentous D-shaped backend comb, a color cap with a sponge, a spatula, and a flat cover when not utilizing a liquid or cream in the airtight compartment. Another device utilizes a rigid airtight compartment with a piston to eject the fluid.

19 Claims, 4 Drawing Sheets

COMBINATION SALON TOOL DEVICE

BACKGROUND OF THE INVENTION

1. Field of the Invention

The present invention relates generally to a hair dressing chemical dispenser device and, more specifically, to a combination salon tool device with a rat-tail comb at one end of an airtight compartment for dispensing perm solutions, creams and the like, and adapted to enable interchangeability of a plurality of dispensing attachments on the opposite end for the brush.

2. Description of the Related Art

The related art of interest shows various hair dressing tools with various combinations. The related art will be discussed in the order of perceived relevance to the present invention.

U.S. Pat. No. 5,388,728 issued on Feb. 14, 1995, to Jean-Louis Gueret describes a device for dispensing a fluid product such as a cosmetic or a pharmaceutical product. In FIGS. 26 *a–c*, a comb has a handle comprising a rigid cylindrical shell with an air intake opening and containing a flexible bag. The comb portion at one end fits inside the handle and the flexible bag. A dome with a valve is proximate to the handle. The opposite end of the comb portion is a comb with teeth on two sides which receives the liquid when the dome is pressed and causes two obturator valves on the comb portion to release the liquid onto the teeth. The device is distinguishable for its dome portion and three valves which supplies the liquid onto the comb teeth and not through the teeth as in the present invention.

U.S. Pat. No. 5,311,887 issued on May 17, 1994, to Floyd W. Ramsey describes a microwaveable transparent plastic comb for holding and dispensing a liquid through a detachable hollow comb teeth with a plurality of outlets in each tooth. A supplemental dispensing tooth can be removably attached to a flat cap threaded onto an opposite end for applying a liquid to small areas. When the supplemental tooth is removed from the flat cap, the comb may be stored with the comb teeth end up. The liquid dispensed may be hair grease, a gel, a dye or a mousse. A removable plastic comb cover may be positioned over the multiple teeth comb, and the covered comb may be used to style the hair. The comb is distinguishable for its non-flexible capped storage chamber or reservoir, a singular multi-tooth comb attachment, and the lack of a valve which permits outflow as long as the comb is tilted below the horizontal position.

U.S. Pat. No. 5,339,839 issued on Aug. 23, 1994, to Jack L. Forcelledo et al. describes a comb with a fluid applicator of two possible structures for dispensing hair conditioners, dyes and shampoos. The first embodiment comprises a flexible bottle which screws onto a comb with hollow teeth. The comb is distinguishable for its limitation to only one comb attachment, wherein the teeth are normal or perpendicular to the longitudinal axis of the bottle.

U.S. Pat. No. 5,056,480 issued on Oct. 15, 1991, to Ralph Murray, Sr. describes a liquid comb combination and method for its manufacture. The plastic comb has rigid hollow teeth on a shank threaded to a flexible hollow liquid handle having two separate reservoirs, each openable by a lockable flap. Two liquids (dyes) of different viscosities are stored and dispensed through one of two comb sides of hollow teeth with different sized apertures. The comb dispenser is distinguishable for its reliance on two separate reservoirs for different teeth sides of the comb.

U.S. Pat. No. 5,555,899 issued on Sep. 17, 1996, to Karen A. Foreman describes a hair liquid applicator for treating only hair roots with hair gel or dyes. A plastic squeeze bottle is attached to a threaded attachment with five inclined and hollow fingers. The applicator is distinguishable for its limitation to an inclined comb for treating only hair roots and no need for a valve.

U.S. Pat. No. 1,686,981 issued on Oct. 9, 1928, to Oscar O. Olson describes a scalp comb for dispensing a medicament or dressing from a hard rubber or celluloid comb having seven hollow teeth differing in length with the center teeth being the shortest to fit a curved scalp. The scalp engaging end of each hollow tooth is slightly recessed on one side to minimize clogging. A soft rubber bulb is the reservoir for the medicament or dressing. The scalp comb is distinguishable for its perpendicular orientation of the teeth to the bulb and reliance on only one attachment.

U.S. Pat. No. 1,770,943 issued on Jul. 22, 1930, to Frank H. Newton describes an electric fountain appliance for applying two different heated lotions from separate reservoirs to a comb and to a roller device. The comb and roller are directed normal to the axis of the handle. The appliance is distinguishable for its inflexible reservoirs and the orientation of the comb and roller on the handle.

U.S. Pat. No. 2,103,493 issued on Dec. 28, 1937, to Charles P. Robertson describes liquid dispensing bristled devices for men and women. The external casing differ in shape, but the internal push button pump inside the fluid reservoir is identical to force the fluid out. The devices are distinguishable for its required pumps and fixed bristles.

U.S. Pat. No. 2,532,001 issued on Nov. 28, 1950, to Norman Williams describes an insecticide comb-applicator consisting of three interfitting parts which are the plastic tubular comb back and bulb extension cover, a lower plastic comb teeth portion, and a collapsible bulb which contains the antiseptic powder, chalk or Fuller's earth. The comb-applicator has only several powder distributing teeth distributed among the comb teeth. The comb-applicator is distinguishable for its totally dissimilar structure.

U.S. Pat. No. 3,101,086 issued on Aug. 20, 1963, to Salvatore S. Di Vito describes a combined dispenser and comb for sprinkling water, shampoo, dye, and setting solution on hair. A transparent or translucent calibrated flask is provided with a flow control plug and a hollow comb with a tapered hollow or solid hair divider at its distal end and open-ended teeth separated by pairs of solid teeth arranged perpendicular to the longitudinal axis of the comb and flask. The dispenser-comb is distinguishable for its single attachment and control plug.

U.S. Pat. No. 4,310,009 issued on Jan. 12, 1982, to Anthony D. Shipp describes a plastic combing and applicator device for disinfecting animal pets and scalps. The flexible fluid or powder reservoir is provided with a valve. The disinfectant is distributed by either gravity or squeezing of the reservoir container to flow into the comb housing which has inclined hollow teeth with V-slotted openings. The comb housing has a baffle proximate the comb for better distribution. The device is distinguishable for its limitation to an inclined comb.

U.S. Pat. No. 4,592,376 issued on Jun. 3, 1986, to Ludwig Sigmund et al. describes a hair dye applicating apparatus comprising an elastic transparent cylindrical supply container with a cover containing a comb ending in a hair separating tip without distribution channels and a removable brush with distribution channels in a rubber nozzle insert. Hydrogen peroxide and hair dye are added to the supply container, mixed and ejected by squeezing the supply container. A second embodiment utilizes a stiff reservoir with a projecting piston rod and actuator button to eject the liquid. The applicators are distinguishable for their non-liquid distributing combs and the adjacent positions of the comb, brush and hair separating tip.

U.S. Pat. No. 5,054,504 issued on Oct. 8, 1991, to Robert L. Winrow describes a scalp applicator for selective application of a lotion and a simultaneous scalp massage by utilizing a battery operated vibrator. A rigid head member can be three-fingered (hollow) or a hollow cone with an alignment rib, abutments and body massage projections to hold a sponge sleeve. The lotion is distributed from a flexible bladder body portion to the tips of the fingers or cones. The applicator is distinguished by its requirement for a vibrator.

U.S. Pat. No. 5,289,833 issued on Mar. 1, 1994, to Charles E. McDonald describes a multi-toothed dispenser, comb applicator and bottle device. A deformable plastic bottle is attached to a plastic hollow comb with either a capped (first embodiment) or an uncapped hair separator end (second embodiment). The hair dye or perm solution is distributed from the open hair separator in the preferred embodiment or from dispensing holes in the spine of the comb in the alternative embodiment. The applicator is thus distinguishable for lacking a valve for controlling the flow of liquid.

U.S. Pat. No. 5,291,905 issued on Mar. 8, 1994, to Peter Busch et al. describes a hair treatment applicator comprising a capped flat housing which contains a reservoir for the hair-softening or hair-setting liquid saturating a porous base material connected to an upper porous teeth material. The applicator is distinguishable for its singular porous fingers.

E.P.O. Patent Application No. 463,979 A1 published on Jan. 2, 1992, for Gael Diot et al. describes a one-piece dispenser of cosmetics or pharmaceuticals from a tube onto an integrated slotted spatula. The knob of the tube is sheared off by twisting to open the plastic tube. The dispenser is distinguishable for its one-piece construction which does not provide for attachment of other accessories as in the present invention.

U.K. Patent Application No. 969,378 published on Sep. 9, 1963, for Hugh E. McEachran describes a combined toothpaste dispenser and toothbrush. The toothpaste is carried in a stiff cylindrical container which has a toothbrush extending thereof and covered by a press-fit cap. The device is distinguishable for being limited to the dispensing of toothpaste for an appended toothbrush.

None of the above inventions and patents, taken either singularly or in combination, is seen to describe the instant invention as claimed. Thus, a combination salon tool device with an airtight compartment for dispensing perm solutions through various attachments is desired.

SUMMARY OF THE INVENTION

The present invention is a combination salon tool device with an airtight compartment for dispensing a perm and the like solutions or creams. A rat-tail and an accessory attachment are positioned on opposite ends of a flexible body in a first embodiment which contains the solution or cream. The various useful attachments include a perm brush, a circular color cap, a comb, a filamentous D-shaped backend comb, a color cap with a sponge, a spatula, and a flat cover (not shown) when not utilizing a liquid or cream in the airtight compartment.

A second embodiment employs a piston which is advanced by rotation of the rat-tail comb in a rigid casing. The advantage of an airtight compartment in the dispensing device provides hairdressers with a convenient method of applying perm solutions while minimizing the hairdresser's and client's exposure to noxious chemical fumes.

Accordingly, it is a principal object of the invention to provide a combination salon tool device having a rat-tail comb, an airtight perm solution compartment and multiple attachable and functional head elements for dispersing perm solutions in one's hair.

It is another object of the invention to provide a combination salon tool device with a flexible casing including a perm solution containing a flexible bag as a first embodiment.

It is a further object of the invention to provide a combination salon tool device with a flexible casing including a compressing mechanism as a second embodiment.

Still another object of the invention is to provide a combination salon tool device with attachments such as a perm brush, a circular color cap, a comb, a filamentous backend comb, a color cap with a sponge, a spatula, and a cover when not utilizing a liquid or cream present in the airtight compartment.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
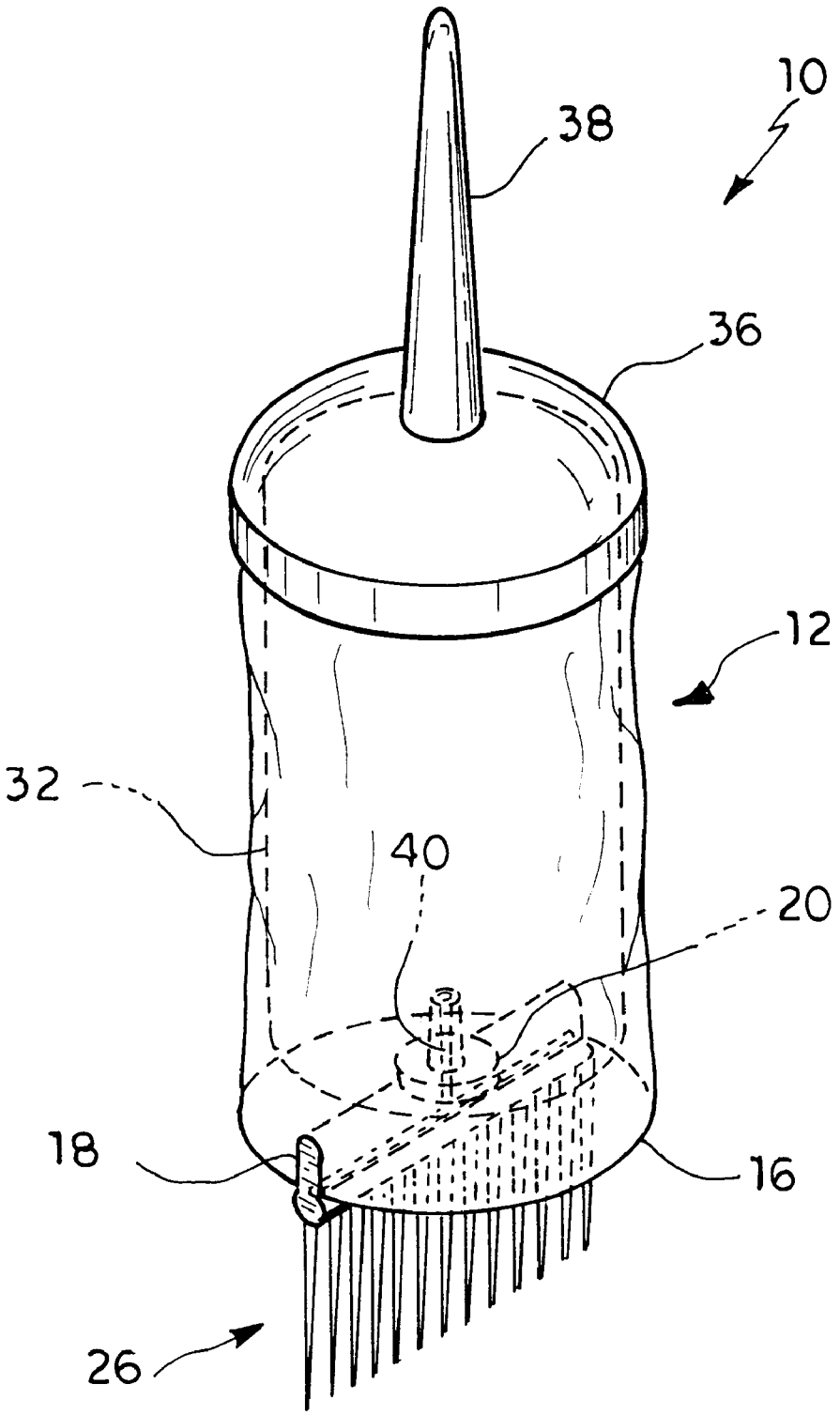
FIG. 1 is a perspective view of a first embodiment of a combination salon tool device with an airtight compartment for dispensing a perm solution through a first perm brush attachment according to the present invention.
Figure 2:
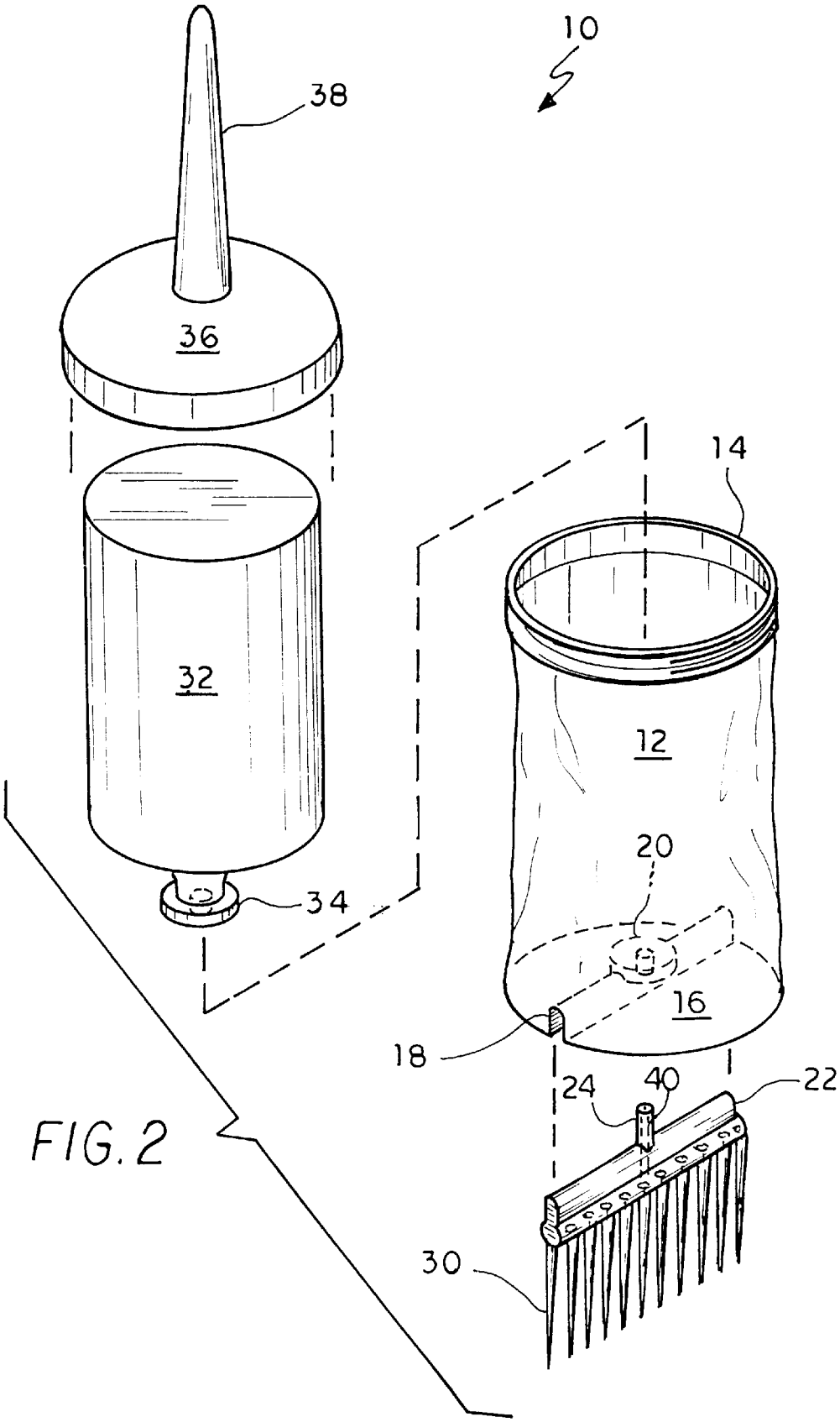
FIG. 2 is an exploded view of the first embodiment FIG. 1 device.
Figure 3:
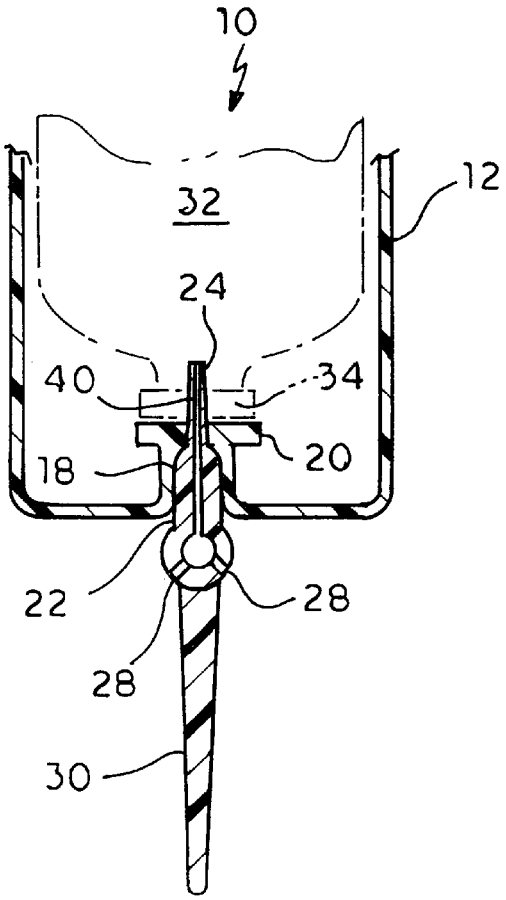
FIG. 3 is a partial sectional view of the anterior portion of the FIG. 1 embodiment.

In FIGS. 1–3, the present invention provides a combination salon tool device 10 having a flexible plastic airtight compartment or casing 12. The cylindrical casing 12 comprises an externally threaded inflexible ring 14 at an open top and a flexible bottom planar surface 16 with a trough 18 and a centered outlet disc 20. The trough 18 accommodates a snug fitting manifold 22 having an inlet pipe 24 of a brush attachment 26 with apertures 28 distributing the liquid to the bristles 30.

The casing 12 holds a flexible plastic bottle 32 containing the noxious solution. The pertinent solutions can be stored in these bottles which are preferably labeled with identification of the contents. The nozzle 34 can be conveniently stoppered for storage. An internally threaded inflexible cover 36 is combined with a rat-tail comb 38.

Every attachment contains a valve 40 in the inlet pipe 24. The valve consists of a flattened rubber tube (not shown) which is opened upon squeezing of the casing 12 for dispensing permanent and the like solutions or creams.

As an alternative, the bottle 32 can be omitted and the hair treating fluid can be directly poured into the casing 12 from its storage container, preferably in the storage room.

Figure 4A:
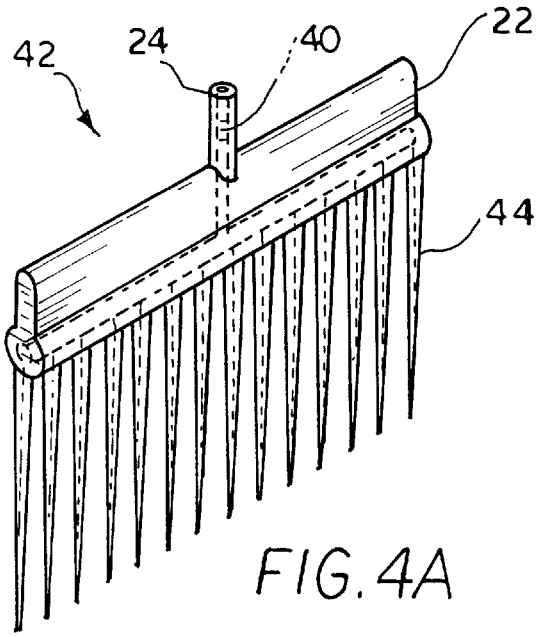
FIG. 4A is a perspective view of a second attachment for dispensing a solution through a comb with hollow teeth.

Turning to the other attachments, FIG. 4A depicts as a second attachment a comb 42 with hollow teeth 44 which communicate with the manifold 22 to permit the flow of fluid when the flexible casing 12 and the flexible plastic bottle 32 is squeezed.

Figure 4B:
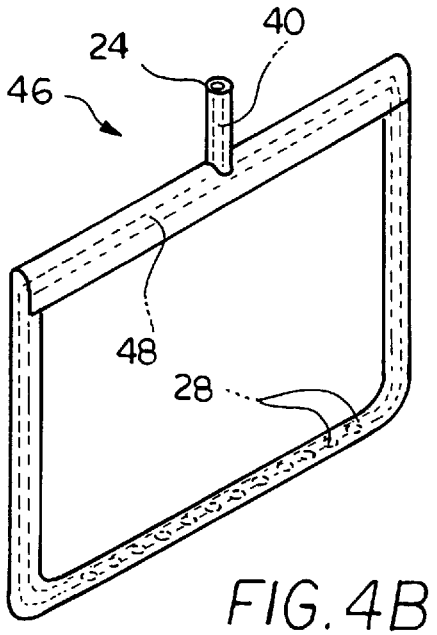
FIG. 4B is a perspective view of a third attachment for dispensing a solution through an apertured backend comb.

FIG. 4B depicts as a third attachment a backend D-shaped comb 46 with a distribution channel 48 traversing the comb from the inlet pipe 24 and valve 40 to the apertures 28 at the distal end. This backend comb 46 is utilized to chemically treat long hair gathered into a bunch which is passed either through the comb or over the comb for contact such as for frosting the hair.

Figure 4C:
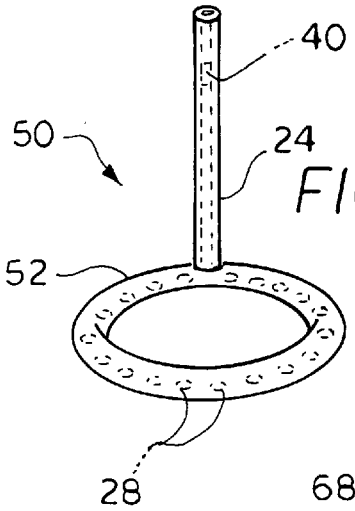
FIG. 4C is a perspective view of a fourth attachment for dispensing a color dye solution from an apertured ring.

FIG. 4C illustrates a fourth ring attachment 50 consisting of a ring 52 connected perpendicularly to the inlet pipe 24 having a valve 40. Since the ring 52 is hollow, the fluid flows out through the spaced apertures 28. This attachment 50 can be utilized to treat hair as explained for the backend comb 46.

Figure 4D:
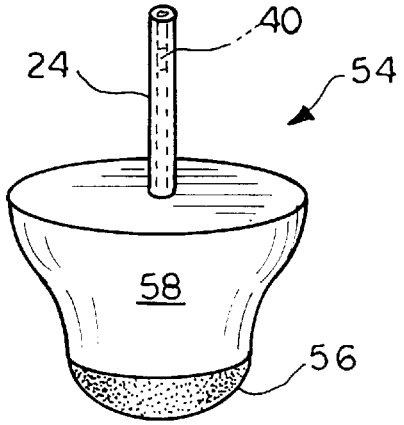
FIG. 4D is a perspective view of a fifth attachment for dispensing a colored hair dye through a sponge.

FIG. 4D shows a fifth sponger attachment 54 including a sponge 56 held in a plastic frustoconical body 58 attached to the inlet pipe 24 containing a valve 40. The sponge 56 can be covered with a cap (not shown) to minimize escape of the fluid's odors.

Figure 4E:
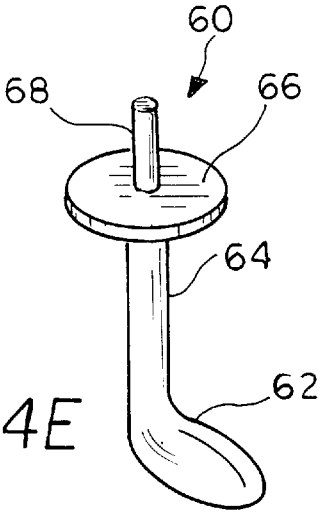
FIG. 4E is a perspective view of a sixth attachment for dispensing a hair cream with a solid spatula.

FIG. 4E depicts a sixth plastic spatula 60 comprising a spatula blade 62 dependent on a stem 64 attached to a circular flange 66 from which a connecting rod 68 extends and penetrates the outlet disc 20 in casing 12. The spatula blade 62 is utilized to spoon out creams and the like viscous material from its container and to apply the creams to the hair.

Figure 5:
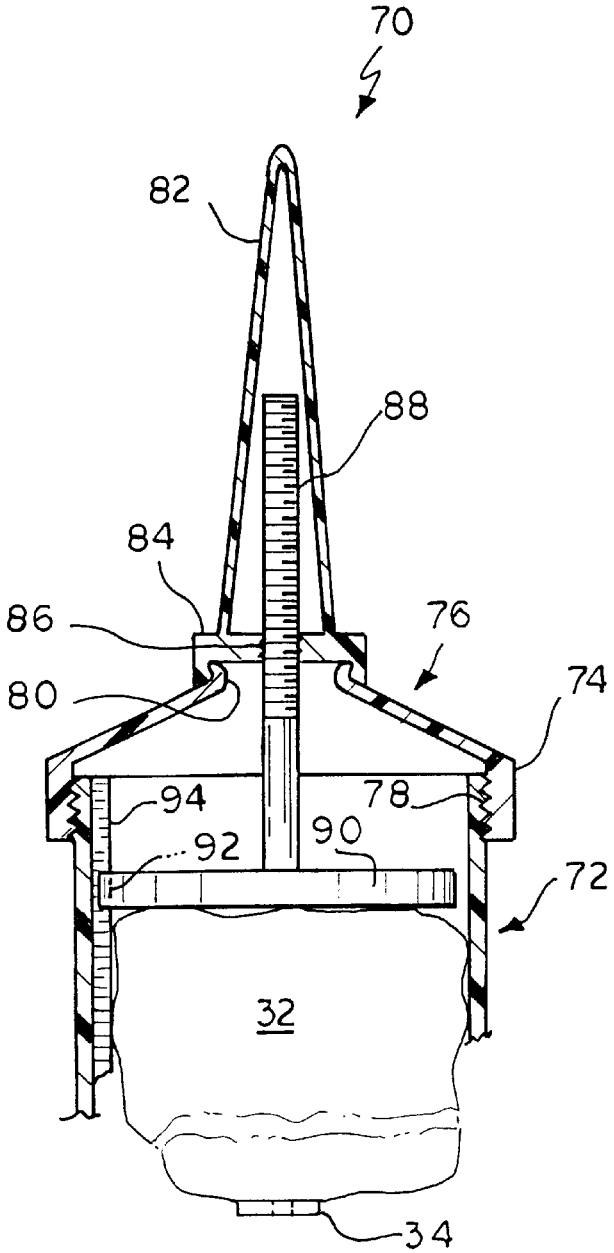
FIG. 5 is a partial sectional view of a second embodiment of a combination salon tool device with a mechanism for compressing the solution filled bag inside a rigid casing.

Turning to the second embodiment device 70 partially shown in section in FIG. 5, the casing and the ejecting procedure has been modified to provide a rigid plastic casing 72 with internal threading 74 on its top end. The internal threading 74 secures a conical cap 76 with external threading 78 and a circular flanged opening 80. A hollow rat-tail comb 82 with a snap-on base 84 having a centered and threaded throughbore 86 contains a threaded piston rod 88. The piston rod 88 is perpendicular to and supports a flat piston 90 which has a notch 92 to travel down on a vertical guide rail 94. By turning the rat-tail comb 82 the piston 90 is advanced down the casing 72 to squeeze out the chemical fluid contained in the flexible plastic bottle 32 out through the nozzle 34 and any of the above attachments 26, 38, 42, 46, 50, and 54.

Thus, the airtight salon tool device with its accompanying liquid dispensing attachments provides the advantages of minimum leakage of noxious liquids and fumes during use. The addition of the rat-tail comb provides an economy of time by permitting the use to continue using the device without laying down the device to pick up a rat-tail comb. The hair styling procedure for the salon operator, a beautician or a at-home user can be performed in less time, makes less or no mess, minimizes the objectionable odors, and prevents awkward spills.

It is to be understood that the present invention is not limited to the embodiments described above, but encompasses any and all embodiments within the scope of the following claims.

I claim:

1. A combination salon tool device with an airtight compartment for dispensing a hair treating solution comprising:

a flexible plastic cylindrical casing having a cap;

a plastic rat-tail comb positioned on said cap;

said casing having a trough with a centered aperture at an opposite end to the cover for attachment of accessories; and an accessory attached to said trough and said centered aperture selected from the group consisting of a permanent brush, a circular color cap, a comb, a filamentous backend comb, a color cap with a sponge, a spatula, and a cover.

2. The combination device according to claim 1, including a flexible plastic liquid container with a neck inverted in said casing.

3. The combination device according to claim 1, including a permanent brush as the accessory.

4. The combination device according to claim 1, including a circular color cap as the accessory.

5. The combination device according to claim 1, including a comb as the accessory.

6. The combination device according to claim 1, including a filamentous backend comb as the accessory.

7. The combination device according to claim 1, including a color cap with a sponge as the accessory.

8. The combination device according to claim 1, including a spatula as the accessory.

9. The combination device according to claim 1, including a cover as the accessory.

10. A combination salon tool device for dispensing a hair treating solution comprising:

an inflexible plastic cylindrical casing having a conical cap with a flanged opening;

a plastic hollow rat-tail comb with an apertured and threaded base positioned on said conical cap and rotatable about said flanged opening;

a flat piston connected to a threaded rod which cooperates with said apertured and threaded base;

a flexible plastic liquid container with a neck inverted in said casing;

said casing having a trough with a centered aperture at an opposite end to the cover for attachment of accessories; and an accessory attached to said trought and said centered aperture selected from the group consisting of a permanent brush, a circular color cap, a comb, a filamentous backend comb, a color cap with a sponge, a spatula, and a cover.

11. The combination device according to claim 10, including a vertical guide rail positioned inside the casing against a wall for guidance of the piston toward the accessory for squeezing the flexible plastic container.

12. The combination device according to claim 11, including a notch in the flat piston at a periphery to cooperate with the guard rail.

13. The combination device according to claim 10, including a permanent brush as the accessory.

14. The combination device according to claim 10, including a circular color cap as the accessory.

15. The combination device according to claim 9, including a comb as the accessory.

16. The combination device according to claim 9, including a filamentous backend comb as the accessory.

17. The combination device according to claim 9, including a color cap with a sponge as the accessory.

18. The combination device according to claim 9, including a spatula as the accessory.

19. The combination device according to claim 9, including a cover as the accessory.

* * * * *